US006418654B1

(12) United States Patent
Trois et al.

(10) Patent No.: US 6,418,654 B1
(45) Date of Patent: Jul. 16, 2002

(54) HANDGUN SAFETY DEVICE

(76) Inventors: Charles J Trois, 15601 R.R. 965, Fredericksburg, TX (US) 78624; Buel Y. Crawford, 9107 Vinewood, Dallas, TX (US) 75228

( * ) Notice: Subject to any disclaimer, the term of this patent is extended or adjusted under 35 U.S.C. 154(b) by 0 days.

(21) Appl. No.: 09/422,896

(22) Filed: Oct. 22, 1999

Related U.S. Application Data

(60) Provisional application No. 60/105,270, filed on Oct. 22, 1998, now abandoned.

(51) Int. Cl.[7] ..... F41A 17/44
(52) U.S. Cl. ..... 42/70.11; 42/66
(58) Field of Search ..... 42/70.01, 70.11, 42/66

(56) References Cited

U.S. PATENT DOCUMENTS

| | | | | | |
|---|---|---|---|---|---|
| 2,478,098 | A | | 8/1949 | Hansen | |
| 2,943,411 | A | | 7/1960 | Salva | |
| 3,027,674 | A | | 4/1962 | Mahan | |
| 3,208,176 | A | | 9/1965 | Giles | |
| 3,378,943 | A | * | 4/1968 | Valburg | 42/70.11 |
| 4,023,294 | A | | 5/1977 | Knopp | |
| 4,092,794 | A | * | 6/1978 | Moren | 42/70.11 |
| 4,136,476 | A | | 1/1979 | Hetrick | |
| 4,479,320 | A | | 10/1984 | Fix | |
| 4,908,971 | A | | 3/1990 | Chaney | 42/70.11 |
| 4,965,952 | A | | 10/1990 | Miller et al. | 42/70.01 |
| 5,048,211 | A | | 9/1991 | Hepp | 42/70.11 |
| 5,052,142 | A | | 10/1991 | Mikus | 42/70.11 |
| 5,070,635 | A | | 12/1991 | Cvetanovich | 42/70.11 |
| 5,097,613 | A | | 3/1992 | Miller et al. | 42/70.11 |
| 5,171,924 | A | * | 12/1992 | Honey et al. | 42/70.11 |
| 5,179,234 | A | | 1/1993 | Cvetanovich | 42/70.11 |
| 5,450,685 | A | | 9/1995 | Peterson | 42/70.11 |
| 5,918,403 | A | | 7/1999 | Lurz, Jr. et al. | 42/70.11 |
| 5,950,344 | A | | 9/1999 | Ross | 42/70.11 |

* cited by examiner

*Primary Examiner*—Stephen M. Johnson
(74) *Attorney, Agent, or Firm*—Eric B. Meyertons; Conley, Rose & Tayon, P.C.

(57) ABSTRACT

Handgun safety devices may prevent the loading of ammunition into a handgun. The safety devices may be inserted into a barrel of a handgun. The safety devices may extend into a firing chamber of the handgun to prevent a bullet from entering the chamber, or to prevent cylinder from rotating in a revolver. An end of the safety device may be configured to resemble the end of the barrel of the handgun. The safety devices may prevent a child, or someone unfamiliar with a handgun, from accidentally loading and discharging a gun. The safety devices may also allow a user of the gun who is familiar with the safety devices the ability to quickly remove the safety device and use the gun.

4 Claims, 6 Drawing Sheets

22
62

64
62
66
60

62
60

60
64
62

HANDGUN SAFETY DEVICE

Priority is claimed with regard to U.S. Provisional Application No. 60/105,270, filed on Oct. 22, 1998, and now abandoned.

BACKGROUND OF THE INVENTION

1. Field of the Invention

The present invention is related to the field of firearms and firearm safety devices, particularly handgun safety devices.

2. Description of the Relevant Art

The most widely used gun locks are designed as two piece devices that snap together over a trigger guard and prevent access to the trigger. These devices typically use a pin and tumbler mechanism and are opened by a key. A drawback to this type of lock is the time required to find a key, unlock the guard and then possibly load the gun. In an emergency situation there may not be enough time to perform all these steps.

Another type of lock is exemplified by the SPEED RELEASE GUN LOCK™, which is a trigger guard lock that does not require a key. This device utilizes an electronic lock, and an activation button that lights a touchpad for a digital security code that unlocks the device. Again, in an emergency situation, it may not be desirable to have to turn on a lighted keypad and remember a security code.

SUMMARY OF THE INVENTION

The problems outlined above may in large part be solved by a safety device that resides within a barrel of a handgun during use. The safety devices described herein are inexpensive and simple to operate. The safety devices may be removed quietly and instantly in total darkness and without a key. The safety devices described herein are able to prevent a child or someone unfamiliar with a handgun from accidentally firing the gun, but allow the owner of the gun to quickly remove the safety device, if needed.

A safety device may be designed to slide into a barrel of a handgun and into a chamber. During use, the device projects into the chamber aligned with the barrel and either prevents the cylinder from rotating in a revolver, or the device prevents a bullet from entering the chamber in a semi-automatic handgun. In certain embodiments, the device may be designed so that a rod may slide directly into a chamber of a revolver and prevent the cylinder from rotating. For example, a casing for the device may be attached to the face of a gun so that the interior of the casing aligns with a chamber in the cylinder. A rod in the casing may then be projected into that cylinder, either when the chamber is empty or when the chamber contains a bullet, as long as the rod projects far enough into the chamber to inhibit rotation of the cylinder. As described below, the rod may be configured to conform to the nose of a bullet so that the rod may more easily project into a chamber that contains a bullet during use.

Alternative embodiments of safety devices may be designed with two pieces and a force applying member (spring) positioned between the two members. During use, the device is placed in the barrel of a pistol and a smaller diameter piece is held at least partially inside a larger diameter piece. When used in a revolver, the smaller diameter piece is pushed into the chamber and prevents rotation of the cylinder. This type of device is effective when the chamber is empty, and is also effective when a bullet is present in the chamber. In either case, as long as the rod or tube projects into the chamber, rotation of the cylinder is prevented and the gun is disarmed. In certain embodiments, an end of the rod may be spring loaded to allow the device to fit within the barrel of a gun when a round of ammunition is loaded in the gun. A spring-loaded device is also effective for use in a semi-automatic handgun. When the semi-automatic is cocked by moving the extractor out of the chamber in order to move a bullet into the chamber, the spring pushes the smaller piece of the safety device into the chamber as the extractor is withdrawn, thus preventing a bullet from entering the chamber.

To disarm a gun, a user may place a safety device within the barrel of the gun. The safety device may be secured to the barrel of the gun by a mechanism which may be, but is not limited to, a spring clip, a cap, and an expansion gasket which forms a friction fit with the barrel. To return the gun to a usable condition, the user may remove the safety device from the gun barrel. After removal of the safety device from the barrel of the gun, the gun may be cocked and/or fired.

In an embodiment, the end of the safety device may be configured to resemble the end of a barrel of a gun. The end of the safety device that resembles the end of the barrel may include a structure that resembles the sight of the handgun. Also, the end of the safety device that resembles the end of the barrel may include a bore that resembles the barrel of the gun. When a safety device which resembles the end of a barrel of a gun is installed in the barrel of the gun, a person who is unaware of the nature of the safety device may believe that the gun is in a usable condition, even though the gun is actually disarmed. This may be advantageous if an unauthorized person has possession of the gun. The person who disarmed the gun will know that the gun remains disarmed. Also, having a gun that appears to be in a usable condition even though the gun is disarmed may be advantageous because a child who picks up the gun will not know that the gun is disarmed, and the child will not know to remove the safety device. Having a gun that appears to be in a usable condition even though the gun is disarmed may be advantageous where the authorized user of the gun does not have sufficient time in an emergency situation to remove the safety device. The gun would still have the appearance of a gun that could be fired.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

Figure 1A:
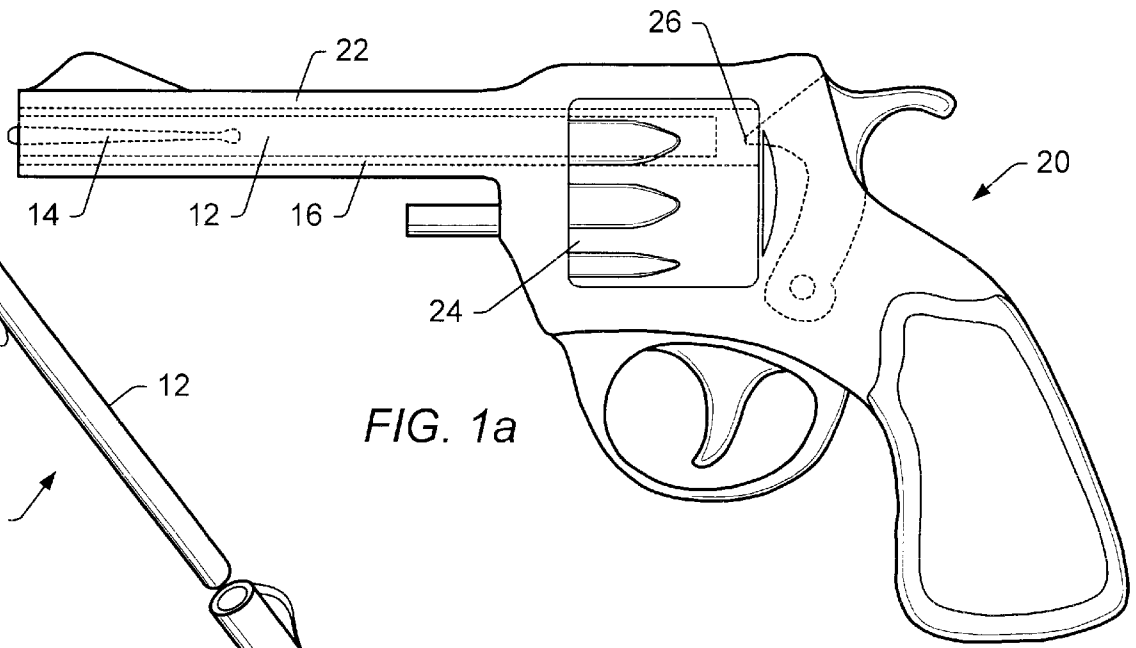
FIG. 1 depicts an embodiment with a single rod or tube.
Figure 1B:
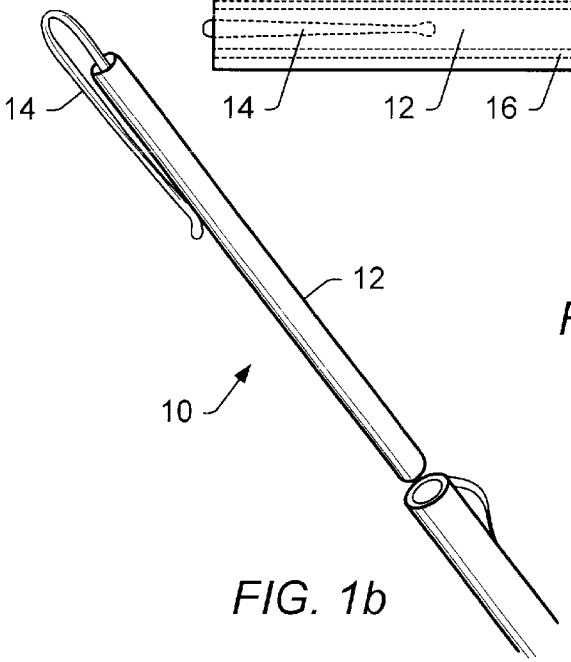
Figure 1C:
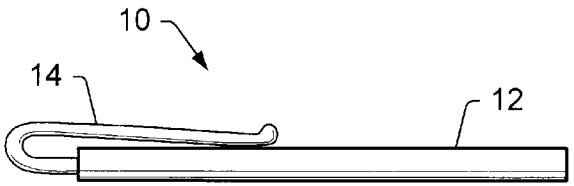
Figure 1D:
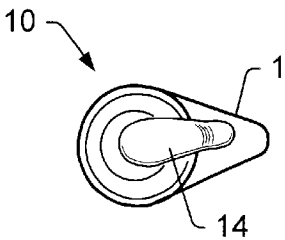
Figure 2B:
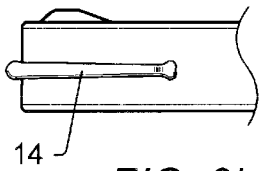
FIG. 2 depicts an embodiment comprising two pieces and a spring load.
Figure 2A:
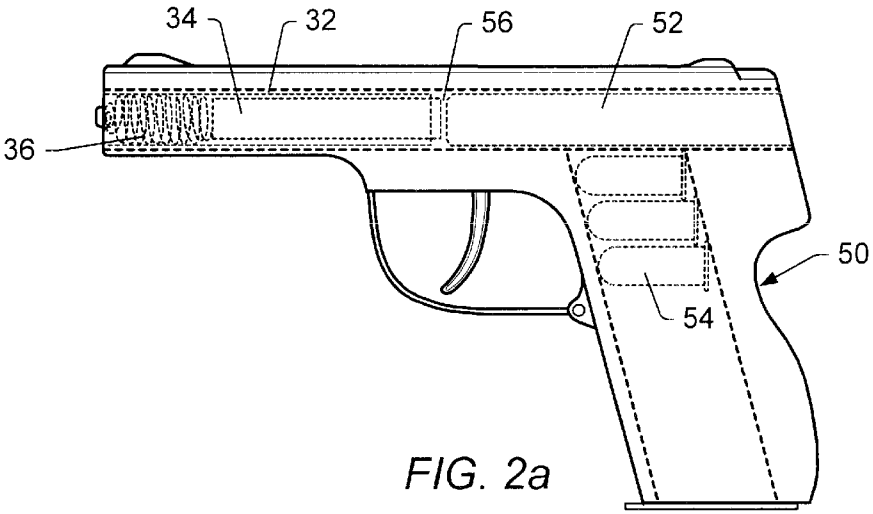
Figure 2C:
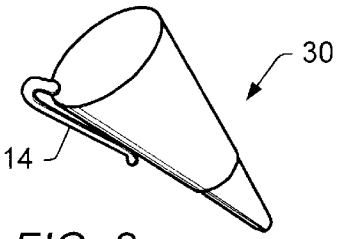
Figures 2D, 2E, 2F:
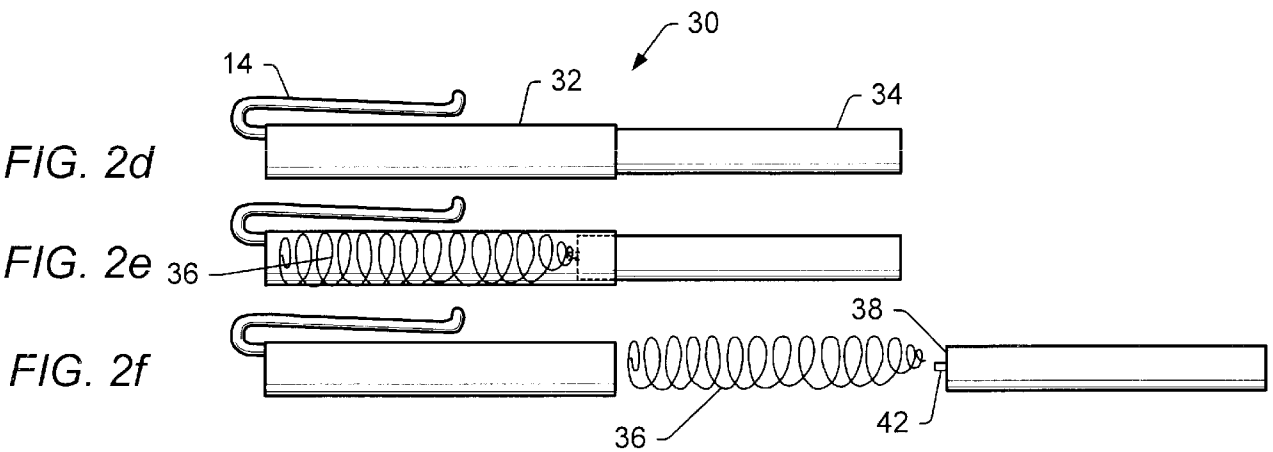

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but to the contrary, the intention is to cover all modifications, equivalents and alternatives falling within the spirit and scope of the present invention as defined by the claims.

DETAILED DESCRIPTION OF THE PREFERRED EMBODIMENTS

FIG. 1 shows an embodiment of a gun safety device 10 that may be used with a revolver 20. The device may include rod 12 and clip 14. The rod 12 may have a hollow center, or the rod may be solid. Alternately, the rod 12 may be a combination of solid portions and hollow portions. The rod 12, or the casings and rods described below may be made of rubber, a plastic, a polymer, a ceramic, wood, a metal such as stainless steel, aluminum, brass, etc. or any other suitable material, or combination of materials. The devices may be supplied with a twelve inch tube or rod 12, which may then be cut to fit a particular gun, or the devices may be supplied in a range of lengths, from about two inches up to about fourteen inches or more as necessary. The tubes 12 may also be provided in a variety of calibers, such as 20 caliber, 30 caliber, 40 caliber, 50 caliber and increments between those that would include, but is not limited to 22 caliber, 38 caliber, 44 caliber, etc. In certain embodiments, the devices may be manufactured to be compatible with a particular brand and caliber of firearm, and in other embodiments they may be more generically designed. Any of the devices described herein may be colored to match the finish of a handgun, either blued steel or stainless, for example. The tubes or rods 12 may also be provided in a variety of shapes in order to be compatible with particular gun barrels. For example, they may be provided as round, rifled, flat, octagonal, square, fluted or other configurations as appropriate.

A spring clip 14 is also shown in FIG. 1. Any of the devices described herein may have one or more spring clips 14 as described herein. The spring clip 14 is a spring that is biased toward the tube 12 so that when the device is inserted into a barrel, the spring clip 14 presses against the barrel and holds the device in place. Spring clips may be made of plastic or metal, such as aluminum, brass, etc and may be of the same color as the tube 12 or they may be of a different color.

A device 10 is shown in place in a revolver 20. The device is inserted in the barrel 22 of the revolver 20 and extends into a chamber 16 of the cylinder 24. When the device 10 is in this position, the cylinder 24 is prevented from rotating to move a bullet in position to be struck by the firing pin 26, and the gun is thus disarmed. When this embodiment is used with a semi-automatic handgun, the rod is configured to project into the chamber, and when an attempt is made to cock the handgun, the bullet jams against the rod and does not properly enter the chamber.

An embodiment of a safety clip is shown in use with a semi-automatic handgun in FIG. 2. The safety device 30 may include an outer casing 32, and a smaller tube 34 that is configured to fit at least partially inside the outer casing 32 during use. The device 30 may also include a spring 36, held inside the outer casing 32 and configured to push the smaller tube 34 out of the outer casing 32 during use. The smaller tube 34 may also include a connector 38 configured to engage the spring 36. The connector 38 may include a pin 42 configured to be hooked to the end of the spring 36. A spring clip 14 is shown that may be of the same construction as the previously described spring clip.

When this embodiment of the invention is in place as shown in FIG. 2, the smaller tube 34 may be almost completely contained inside the outer casing 32, with the spring 36 compressed. In this position, the smaller tube 34 may press against the extractor 52 of the semi-automatic handgun 50. Because the spring 36 is pushing the smaller tube 34 against the extractor 52, as the extractor 52 is withdrawn upon cocking the gun, the smaller tube 34 follows the extractor 52 into the chamber 56, thus preventing a bullet 54 from entering the chamber 56. Even repeated cocking will not allow a bullet to enter the chamber 56 and the gun is disarmed. It is also understood that the embodiment described in this paragraph as being designed for use with a semi-automatic may also be used with a revolver type handgun.

Figures 3A, 3B, 3C, 3D:
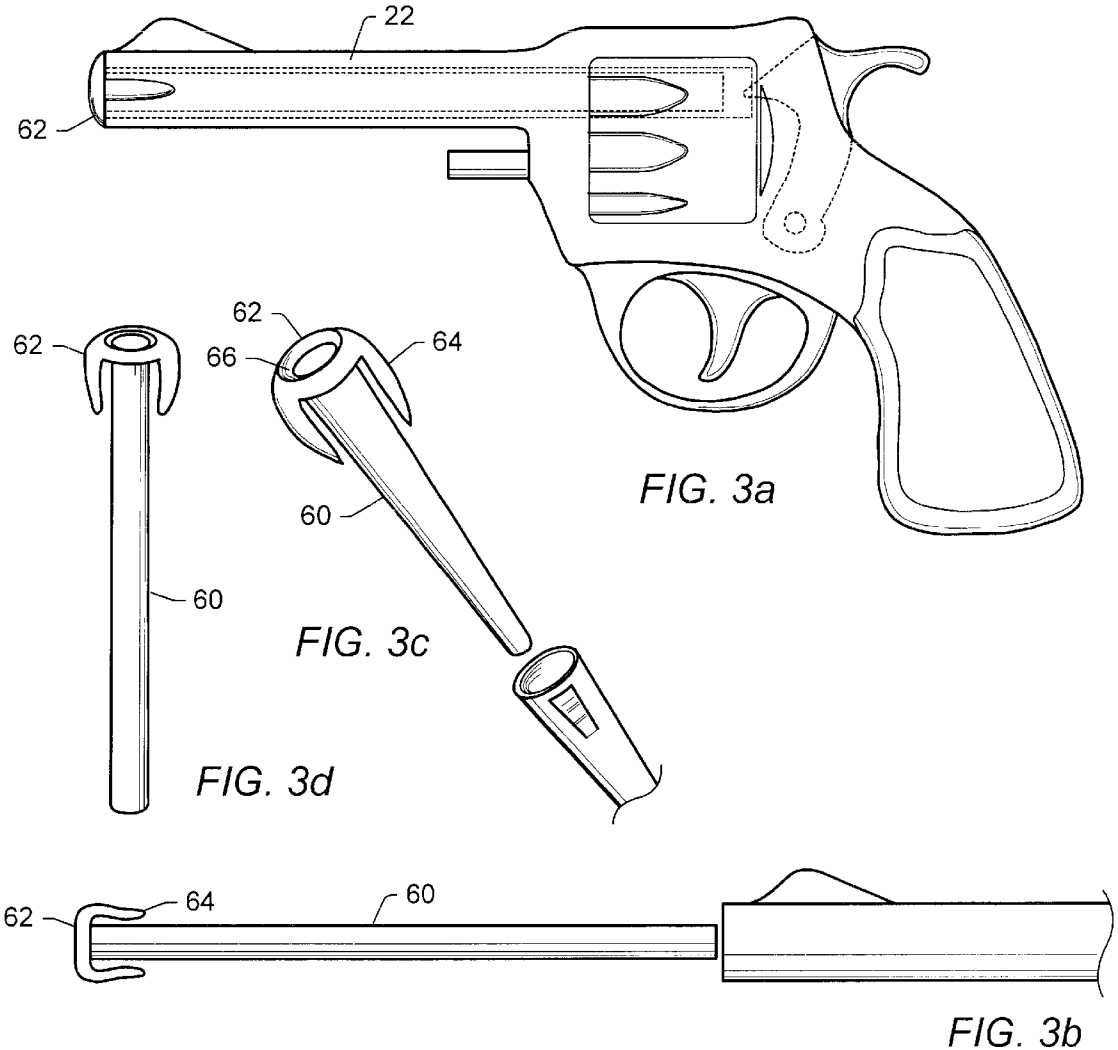
FIG. 3 depicts an embodiment with a single rod or tube.

An embodiment of a device 60 is shown in FIG. 3. This device works like the device shown in FIG. 1, except that the clip 62 may include two or more springs 64 that press against the outside of a barrel 22 to hold the device 60 in place. For example, the device may include 2, 3, 4, 5, 6, 7, or even 8 or more springs. In certain embodiments, the device may include a continuous deformable ring that snaps onto the barrel to hold the device in place during use. In certain embodiments the device 60 may also include an end 66 that fits over the end of a barrel 22. The end 66 may mimic the end of the barrel 22, including possibly providing an opening into the barrel 22 so that the presence of the device 62 is not immediately obvious to an observer. Although the embodiment shown is designed to fit on a substantially round barrel 22, a clip 62 may be configured to cover any type of barrel known in the art, including barrels of semi-automatic weapons. As such, the clip 62 shown in FIG. 3 may also be used a device such as device 30 shown in FIG. 2.

Figure 4A:
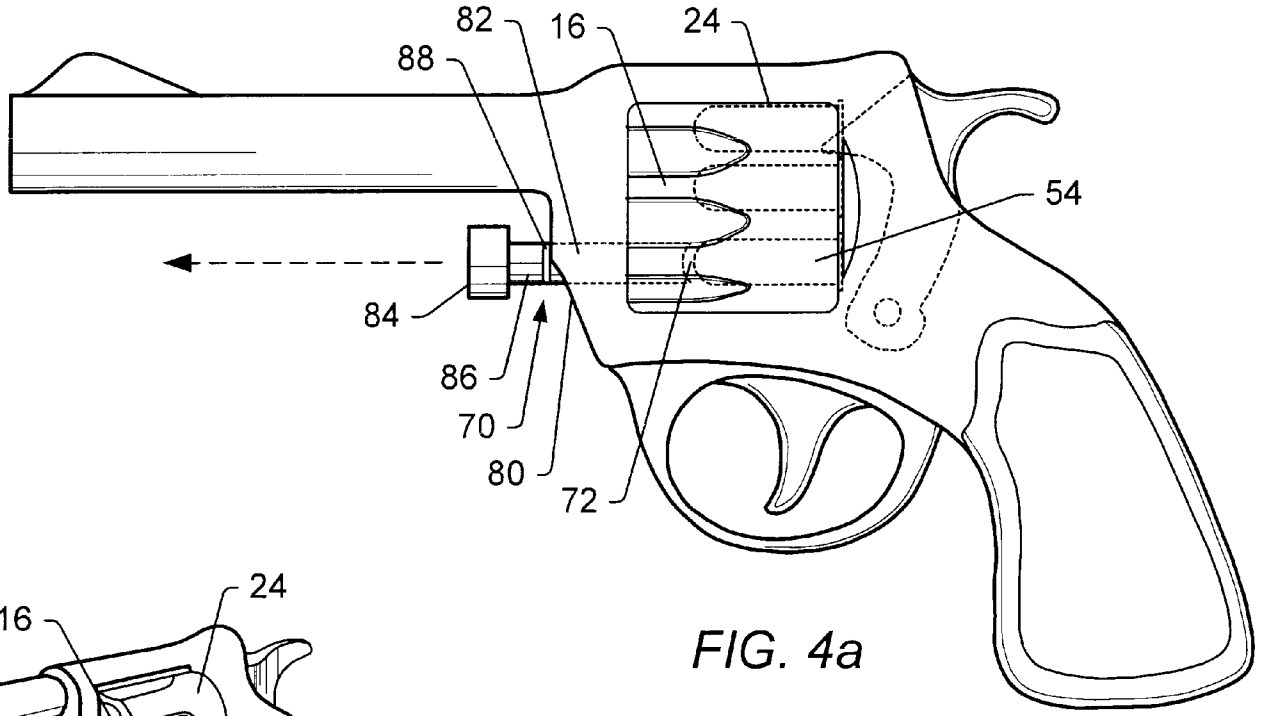
FIG. 4 depicts an embodiment for sliding directly into a chamber of a revolver.
Figure 4B:
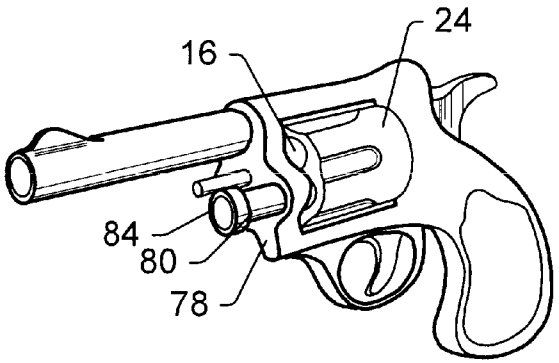
Figure 5A:
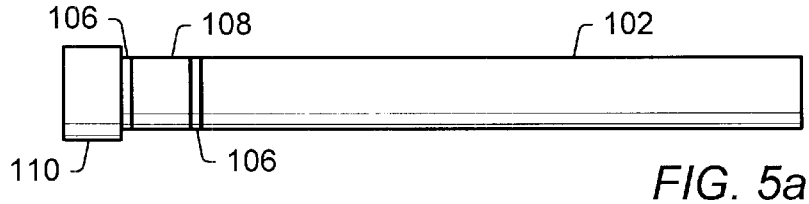
FIG. 5 depicts an embodiment securable by a nut.
Figure 5B:
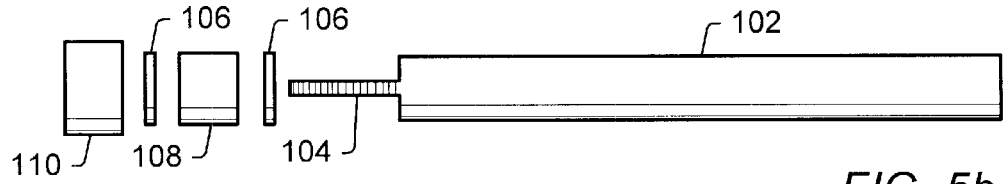
Figure 5C:
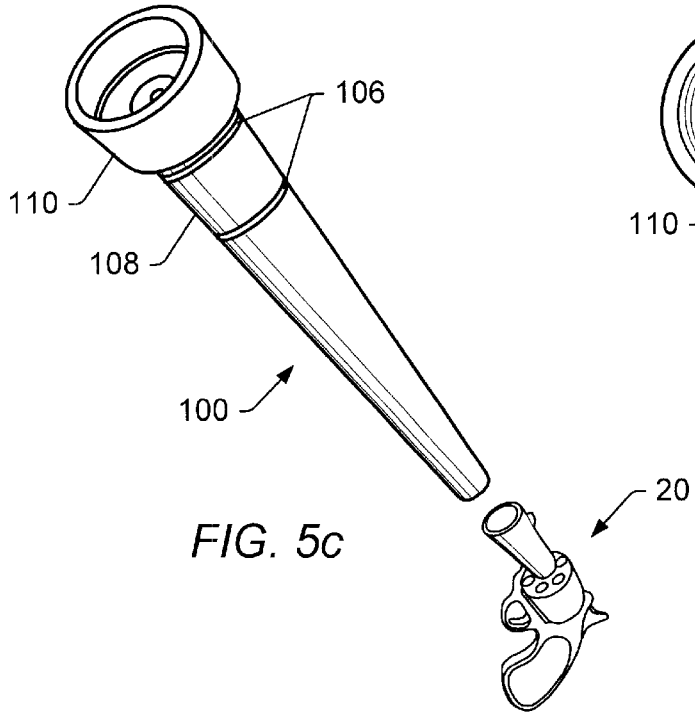
Figure 5D:
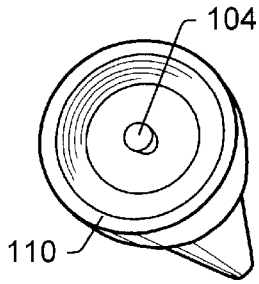
Figure 6A:
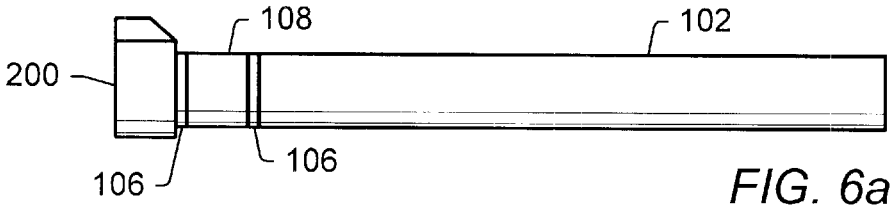
FIG. 6 depicts an embodiment wherein an end of the safety device resembles the end of a barrel of a gun.
Figure 6B:
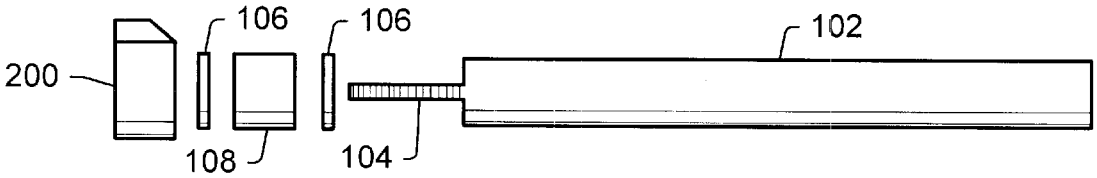
Figure 6C:
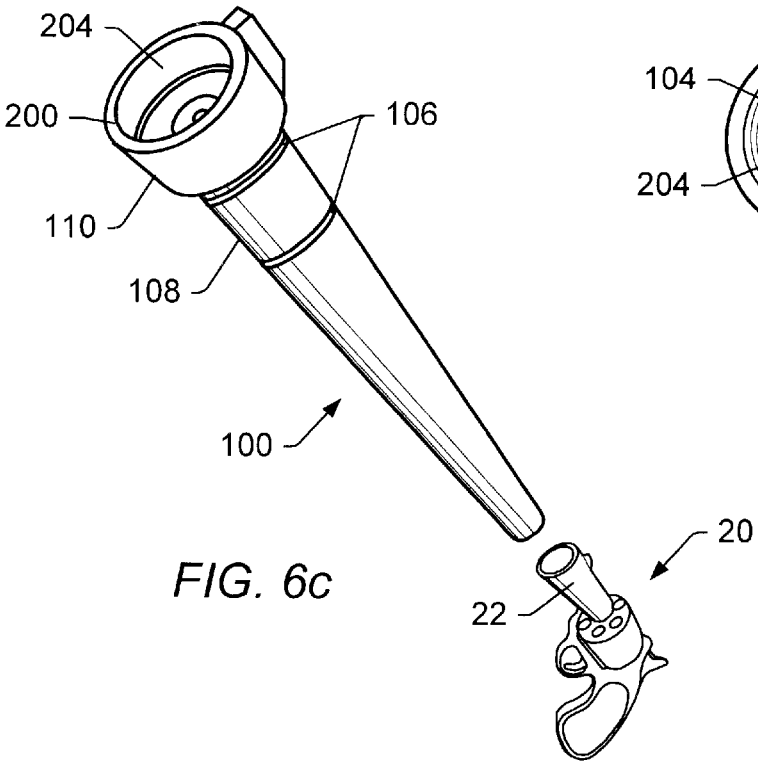
Figure 6D:
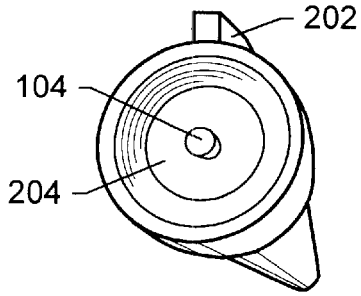

An embodiment of a device 70 is shown in FIG. 4. The device 70 is configured to be inserted directly into a chamber 16 of a revolver. Insertion of device 70 prevents the cylinder 24 from rotating when an attempt is made to pull the trigger. The device 70, includes an end 72 that may rest against a bullet 54 held in a chamber 16, or the end 72 may enter the chamber 16 and not reach as far as the nose of a bullet 54 if present. In this embodiment, the device 70 may include an outer casing 80 built into or permanently attached to the face 78 of the gun and an inner tube or rod 82 that slides within the outer casing 80. The inner rod 82 may also include a nut 84 and a deformable washer 86 disposed between two metal washers 88. The device may also include a threaded projection (not shown) attached to inner rod 82 and configured to pass through washers 86 and 88 to mate with nut 84. When the nut 84 is tightened onto the projection, the deformable washer 86 is squeezed out against the inside of the casing 80 to hold the device in place.

A device 100, shown in FIG. 5 may be used in a revolver 20, or it may be adapted to be used in a device for a semi-automatic handgun. The device 100 includes a tube or rod 102 to be inserted in a barrel. Although the device 100 is described as used in a revolver, it is understood that the device 100 is easily adapted to semi-automatic, in which the tube 102 would be replaced with an outer casing to hold a smaller diameter tube and spring. The device 100 may include a threaded projection 104 attached to the tube 102. The device may also include a deformable member, such as a rubber washer 108 disposed between two non-deformable washers 106 that are preferably constructed of metal. The device 100 may also include a nut 110 threadable on the projection 104. The washers 106 and 108 provide openings therein to be slidable onto the projection 104. During use, when the device is inserted into a barrel, the nut may be tightened until the deformable washer 108 becomes squeezed between the non-deformable washers 106 and is thus squeezed out against the inside of the barrel, thus holding the device 100 in place. In certain embodiments, the threaded nut may also be disposed directly against the deformable washer 108 in lieu of a second washer.

FIG. 6 shows an embodiment of a device 10 wherein end 200 of the device is configured to resemble the end of a barrel 22 of a gun. The end 200 of the device 10 may include a sight 202 and a bore 204. The sight 202 and the bore 204 of the end 200 give the device the appearance of a gun barrel when the device is installed in a gun and a viewer looks at the gun straight into the barrel. The gun may appear to be functional when the device 10 is installed in the gun, even though the gun is actually disarmed.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A handgun safety system, comprising:

a handgun;

a casing, wherein at least a portion of the casing is positionable in a barrel of the handgun;

a mount coupled to the casing, the mount configured to couple the casing to the barrel near an exit end of the barrel;

an elongated member configured to be at least partially contained in the casing, wherein the elongated member is insertable into the barrel so that the elongated member extends into a firing chamber of the handgun;

a force applying member coupled to the casing and the elongated member, wherein the force applying member extends the elongated member to an initial position relative to the casing; and wherein the elongated member partially retracts within the casing when the mount is coupled to the barrel and force is applied to an end of the elongated member, and wherein wherein the elongated member prevents a round of ammunition from being positioned in a firing chamber of the handgun when the mount is coupled to the barrel and the elongated member is positioned in the barrel.

2. The safety system as defined in claim 1, wherein the mount comprises a clip.

3. The safety system as defined in claim 1, wherein the handgun comprises a semi-automatic handgun.

4. The safety system as defined in claim 1, wherein the mount is configured to resemble an end of a gun barrel.

* * * * *

UNITED STATES PATENT AND TRADEMARK OFFICE

CERTIFICATE OF CORRECTION

PATENT NO. : 6,418,654 B1
DATED : July 16, 2002
INVENTOR(S) : Trois et al.

It is certified that error appears in the above-identified patent and that said Letters Patent is hereby corrected as shown below:

Column 6,
Line 18, please delete “wherein wherein” and substitute therefor -- wherein --.

Signed and Sealed this

Eighteenth Day of February, 2003

JAMES E. ROGAN
*Director of the United States Patent and Trademark Office*